US007878120B1

(12) United States Patent
Nodarse et al.

(10) Patent No.: US 7,878,120 B1
(45) Date of Patent: Feb. 1, 2011

(54) AMMUNITION DATA LINK

(75) Inventors: Robert Nodarse, Newton, NJ (US); Anthony Vella, East Hanover, NJ (US); Thomas V. Louzeiro, Wayne, NJ (US); David P. Fairman, Jr., Dover, NJ (US); Steven Pigliavento, Burnt Hills, NY (US); Jessica M. Monahan, Montclair, NJ (US); Amy Lynn Mera, Bangor, PA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 495 days.

(21) Appl. No.: 12/006,752

(22) Filed: Dec. 20, 2007

(51) Int. Cl.
*F42B 5/08* (2006.01)

(52) U.S. Cl. ..... 102/472; 102/464; 102/469; 102/470

(58) Field of Classification Search ..... 102/464–470, 102/472, 481; 89/6, 6.5; *F42B 5/08*
See application file for complete search history.

(56) References Cited

U.S. PATENT DOCUMENTS 3,815,271 A * 6/1974 Lynn ..... 42/84
3,952,658 A * 4/1976 Broyles ..... 102/438
4,019,421 A * 4/1977 Strom ..... 89/1.51
4,979,424 A * 12/1990 Becker et al. ..... 89/6.5
5,171,932 A * 12/1992 McElroy ..... 89/8
5,263,416 A * 11/1993 Amundson et al. ..... 102/202.9
6,138,547 A * 10/2000 Larsson et al. ..... 89/6.5
6,237,494 B1 * 5/2001 Brunet et al. ..... 102/202.7
6,703,580 B2 * 3/2004 Brunet et al. ..... 219/121.52
6,796,243 B2 * 9/2004 Schmees et al. ..... 102/472
7,451,702 B1 * 11/2008 Dindl et al. ..... 102/472
7,581,499 B2 * 9/2009 Stark et al. ..... 102/472
2002/0170455 A1 * 11/2002 Pierrot et al. ..... 102/472

* cited by examiner

*Primary Examiner*—Peter M Poon
*Assistant Examiner*—Marisa Conlon
(74) *Attorney, Agent, or Firm*—Michael C. Sachs

(57) ABSTRACT

A cartridge includes a cartridge case base having a bottom surface, a primer and an annular recess formed in the bottom surface, the annular recess being concentric with the primer; first and second concentric conductive rings disposed in the annular recess, the first and second rings being radially spaced apart and substantially flush with the bottom surface of the cartridge case base, the first and second rings being electrically insulated from the cartridge case base and the primer; a first data pin electrically connected to the first conductive ring and extending into an interior of the cartridge case base; and a second data pin electrically connected to the second conductive ring and extending into the interior of the cartridge case base, the first and second data pins being electrically insulated from the cartridge case base.

7 Claims, 2 Drawing Sheets

AMMUNITION DATA LINK

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and in particular to seeker and/or fuze setting type or "smart" munitions.

Some gun launched cartridges, such as 120 mm cartridges, include onboard electronics for guidance and/or fuzing. Prior to firing these cartridges, data and/or electrical power are transferred to the projectile using a data link. The data can include firing platform and downrange targeting information. Data transmission is initiated by the weapon's fire control system and transmitted through the breech of the gun into the cartridge. A known data link is embedded in the primer, which is inserted into the standard 120 mm case base assembly. The data transmission point is the standard 120 mm firing pin. The case base itself provides the electrical ground necessary to complete the electrical firing circuit when the breech block is in the closed position.

In the primer based data link, the data transmission circuit and the weapon's electrical firing circuit are the same. Thus, data transmission is susceptible to line noise from the firing circuit. Furthermore, there is some risk of unintended firing of the cartridge during data transmission. There is a need for a data link for a cartridge that is separate from the firing circuit for the cartridge.

It is an object of the invention to provide a gun launched cartridge having a data link that is isolated from the firing circuit and having two way communications between the weapon's fire control system and the cartridge while inside the gun chamber.

One aspect of the invention is a cartridge case comprising a cartridge case base having a bottom surface, a primer and an annular recess formed in the bottom surface, the annular recess being concentric with the primer; first and second concentric conductive rings disposed in the annular recess, the first and second rings being radially spaced apart and substantially flush with the bottom surface of the cartridge case base, the first and second rings being electrically insulated from the cartridge case base and the primer; a first data pin electrically connected to the first conductive ring and extending into an interior of the cartridge case base; and a second data pin electrically connected to the second conductive ring and extending into the interior of the cartridge case base, the first and second data pins being electrically insulated from the cartridge case base.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

In an ammunition data link in accordance with the invention, data transmission is isolated from the weapon's firing circuit, thereby reducing line noise and the risk of unintended firing of the cartridge. The ammunition data link is bi-directional. The ammunition data link can transmit and receive data (including built-in test data) to and from the projectile within an allocated time to support the weapon's firing rate while providing the initial power to the cartridge's data link circuit. The ammunition data link case base can also be used to upload upgraded software and perform diagnostics at the storage facility or on the vehicle. The ammunition data link case base can withstand gun chamber pressures in excess of 105 kpsi without any gas leakage. The ammunition data link case base can survive user and autoloader handling and can be extracted with forces equal to standard case bases.

Figure 1:
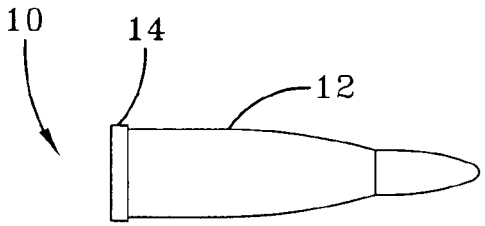
FIG-1 PRIOR ART
FIG. 1 is a side view of a known cartridge.
Figure 2:
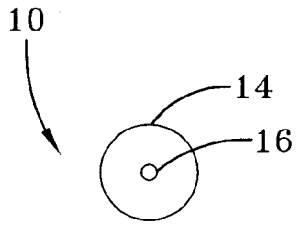
FIG-2 PRIOR ART
FIG. 2 is a bottom view of FIG. 1.

FIG. 1 is a side view of a known cartridge 10 having a case 12. Case 12 has a case base 14. FIG. 2 is a bottom view of the cartridge 10 of FIG. 1 showing a primer 16. In known data links, a data link primer (not shown) is substituted for the primer 16.

Figure 3:
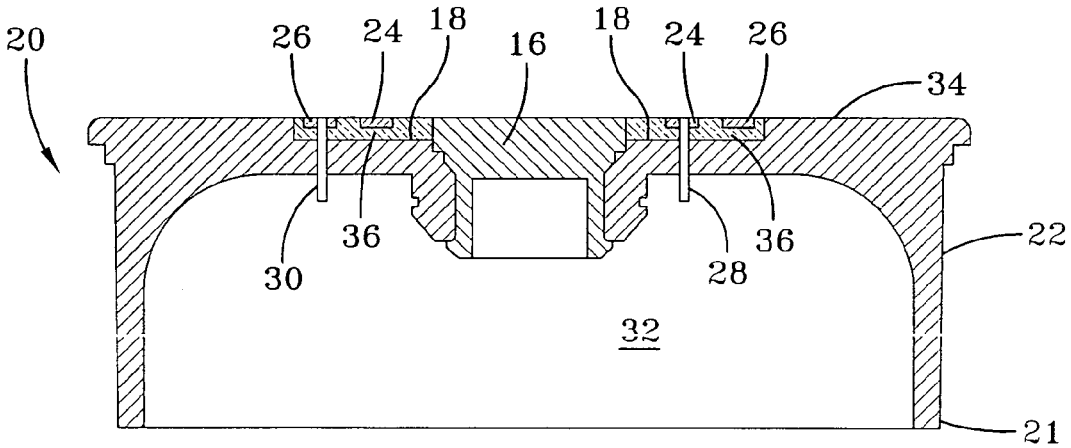
FIG. 3 is a sectional view of one embodiment of the invention.

FIG. 3 is a partial sectional view of an embodiment of a cartridge 20 in accordance with the invention. Cartridge 20 includes a cartridge case 21 with a case base 22. Case base 22 has a bottom surface 34 and an interior 32. A primer 16 is inserted in the case base 22. An annular recess 18 is formed in the bottom surface 34. The annular recess 18 is concentric with the primer 16. First and second concentric, electrically conductive rings 24, 26 are disposed in the annular recess 18. The first and second rings 24, 26 are radially spaced apart and substantially flush with the bottom surface 34 of the cartridge case base 22. The first and second rings 24, 26 are electrically insulated from the cartridge case base 22 and the primer 16 by an isolator or insulating material 36.

A first data pin 28 is electrically connected to the first conductive ring 24 and extends into an interior 32 of the cartridge case base 22. Similarly, a second data pin 30 is electrically connected to the second conductive ring 26 and extends into the interior 32 of the cartridge case base 22. Data pins 28, 30 are electrically isolated from the case base 22. The ends of the data pins 28, 30 in the interior 32 of the case base 22 connect with wiring (not shown) to the projectile in the interior 32.

The cartridge 20 is loaded into a gun for firing. The breech of the gun includes a pair of electrically conductive pins (not shown) that are spaced so that one pin contacts the ring 24 and the other pin contacts the ring 26. Because the rings 24, 26 are complete circles, the cartridge 20 may be loaded in any angular orientation and the breech pins will always contact the respective rings 24, 26. The breech pins are connected to the gun's fire control system. Data and/or power is transmitted through the breech pins to the respective rings 24, 26 and then to respective data pins 28, 30 and then to the electronic system of the cartridge 20. Data may also be sent from the electronic system of the cartridge 20 to the fire control system.

Figure 4:
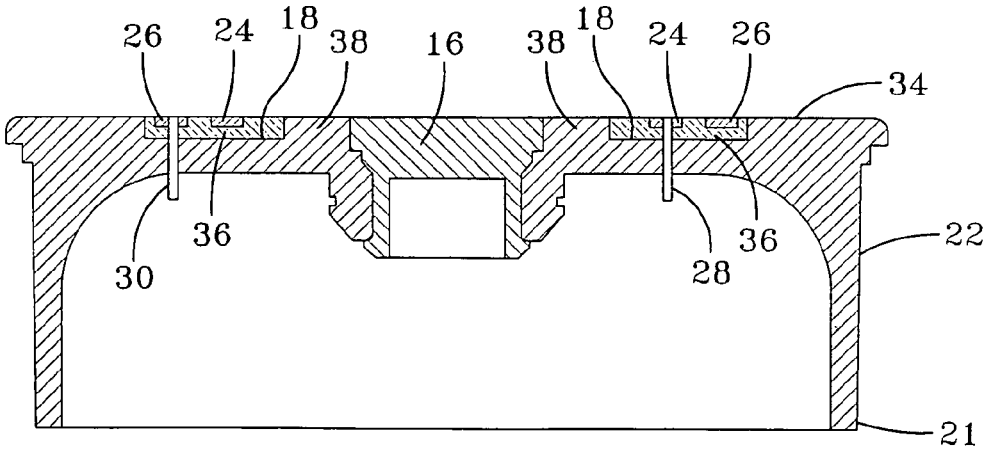
FIG. 4 is a sectional view of another embodiment of the invention.

In FIG. 3, the isolator or insulation material 36 is shown adjacent primer 16. In another embodiment shown in FIG. 4, an annular ring 38 of the case base material is left intact adjacent the primer 16. The annular recess 18 is formed radially outward of the annular ring 38. The embodiment of FIG. 4 provides more mechanical strength in the case base because the annular recess 18 is not directly adjacent the opening for the primer 16.

The rings 24, 26 and isolator or insulation material 36 may be formed in the manner of a circuit board. The circuit board may then be disposed in the annular recess 18 and fastened therein by, for example, a press fit, glue, epoxy, threaded fasteners, etc.

The case base 22 and the interior side of the isolator or insulation material 36 have openings in which the data pins 28, 30 are disposed. Data pins 28, 30 may take a variety of forms, as long as they can transmit electrical signals and are electrically insulated from the case base 22.

Figure 5:
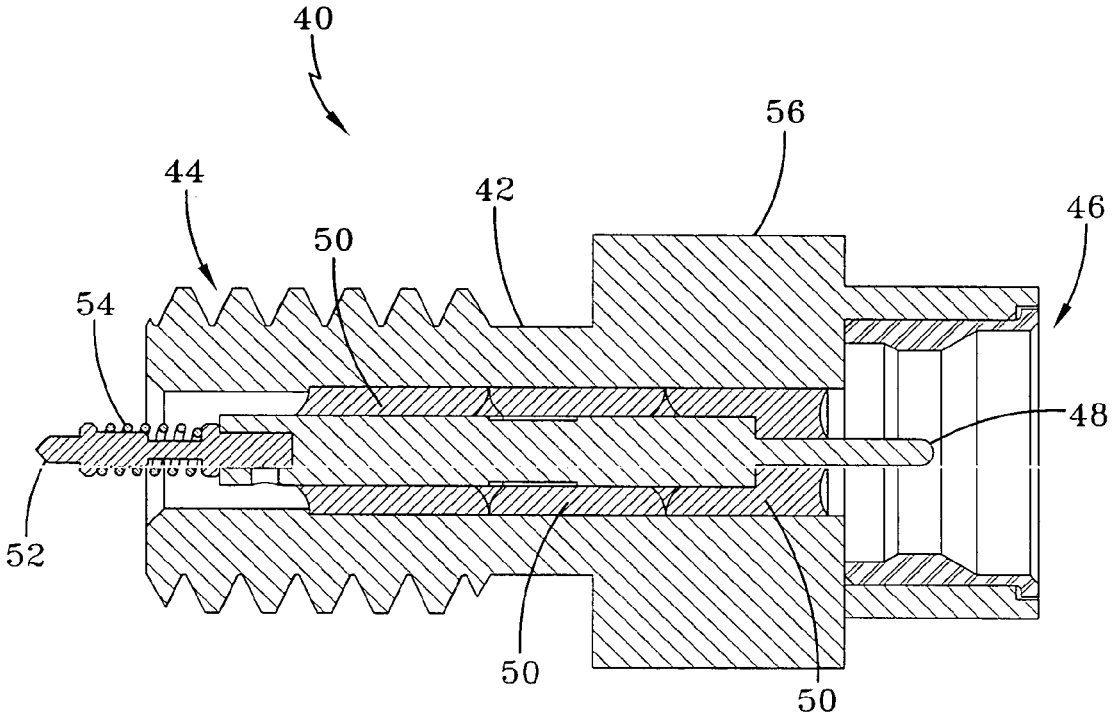
FIG. 5 is a sectional view of one embodiment of a data pin.

FIG. 5 is a sectional view of one embodiment of a feed thru pin 40 that may be used for the data pins 28, 30. Pin 40 includes a housing 42 with an externally threaded portion 44 at one end, for engaging the case base 22. The other end of housing 42 includes a GPO interface 46 for connecting to the wiring inside the cartridge. The housing 42 can also include flats 56 for engaging, for example, a hex head wrench. A conductive rod 48 is disposed in an insulator 50, such as ceramic. One end of the rod 48 forms part of the GPO interface 46. The other end of the rod 48 receives a contact 52 that is outwardly biased by a spring 54. When pins 40 are mounted in case base 22, the tips of contacts 52 are biased into contact with respective rings 24, 26. Pin 40 may also be used without a spring 54. In that case, when pins 40 are mounted in case base 22, the tips of contacts 52 can be soldered into contact with respective rings 24, 26.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A cartridge case, comprising:

a cartridge case base having a bottom surface, a primer and an annular recess formed in the bottom surface, the annular recess being concentric with the primer;

first and second concentric conductive rings disposed in the annular recess, the first and second rings being radially spaced apart and substantially flush with the bottom surface of the cartridge case base, the first and second rings being electrically insulated from the cartridge case base and the primer;

a first data pin electrically connected to the first conductive ring and extending into an interior of the cartridge case base; and a second data pin electrically connected to the second conductive ring and extending into the interior of the cartridge case base, the first and second data pins being electrically insulated from the cartridge case base.

2. The case of claim 1 further comprising electrically insulating material that encases surfaces of the first and second rings except for surfaces substantially flush with the bottom surface of the cartridge case base.

3. The case of claim 1 wherein the first and second data pins each comprise a housing having an externally threaded portion at one end, for engaging the case base.

4. The case of claim 3 wherein the housing includes a portion with wrench flats.

5. The case of claim 3 wherein the housing includes a GPO interface at a second end.

6. The case of claim 5 wherein the first and second data pins each comprise a conductive rod disposed in the housing and surrounded by an insulator.

7. The case of claim 6 wherein the first and second data pins each comprise a contact fixed to an end of the conductive rod and a spring disposed around the contact, the spring biasing the contact away from the conductive rod.

* * * * *